US006979200B2

(12) United States Patent
Ritchie

(10) Patent No.: US 6,979,200 B2
(45) Date of Patent: Dec. 27, 2005

(54) APPARATUS FOR MAKING ELECTRICAL CONNECTION TO A STEERING WHEEL CARRIED PORTION OF AN ELECTRICAL CIRCUIT

(75) Inventor: Norman E. Ritchie, Portland, OR (US)

(73) Assignee: Freightliner LLC, Portland, OR (US)

( * ) Notice: Subject to any disclaimer, the term of this patent is extended or adjusted under 35 U.S.C. 154(b) by 64 days.

(21) Appl. No.: 10/811,086

(22) Filed: Mar. 25, 2004

(65) Prior Publication Data

US 2005/0196978 A1 Sep. 8, 2005

Related U.S. Application Data

(60) Provisional application No. 60/550,513, filed on Mar. 4, 2004.

(51) Int. Cl.[7] ..... H01R 39/00
(52) U.S. Cl. ..... 439/15; 439/27
(58) Field of Search ..... 439/15, 22, 27, 439/164

(56) References Cited

U.S. PATENT DOCUMENTS

| | | | | |
|---|---|---|---|---|
| 3,997,224 A | | 12/1976 | Ogawa et al. | |
| 5,173,065 A | | 12/1992 | Herlache et al. | |
| RE34,693 E | | 8/1994 | Plocek et al. | |
| 5,429,508 A | | 7/1995 | Brevick | |
| 5,735,480 A | * | 4/1998 | Arai et al. | 242/378 |
| 6,007,344 A | | 12/1999 | Corrunker et al. | |
| 6,213,797 B1 | * | 4/2001 | Best et al. | 439/164 |
| 6,462,290 B1 | * | 10/2002 | Matsumoto | 200/61.54 |
| 6,854,977 B2 | * | 2/2005 | DuRocher et al. | 439/15 |

OTHER PUBLICATIONS

Four photographs of prior art electrical ribbon/coil connector and housing for connecting one or more circuits on a rotatable steering wheel to portions of the circuits separate from the rotatable steering wheel.

* cited by examiner

*Primary Examiner*—Thanh-Tam Le
(74) *Attorney, Agent, or Firm*—Klarquist Sparkman LLP

(57) ABSTRACT

An apparatus for maintaining electrical contact to one or more circuits carried by a steering wheel and portions of the circuits separated from the steering wheel comprises first and second housing sections. At least one annulus is carried by one of the housing sections and at least one contact maintaining finger is carried by the other of the housing sections. These components are electrical connected to one another and to respective circuit components to maintain the circuit connections as a steering wheel, that is coupled to one of the first and second housing components, is rotated relative to the other of the first and second housing components that is coupled to the steering column.

22 Claims, 6 Drawing Sheets

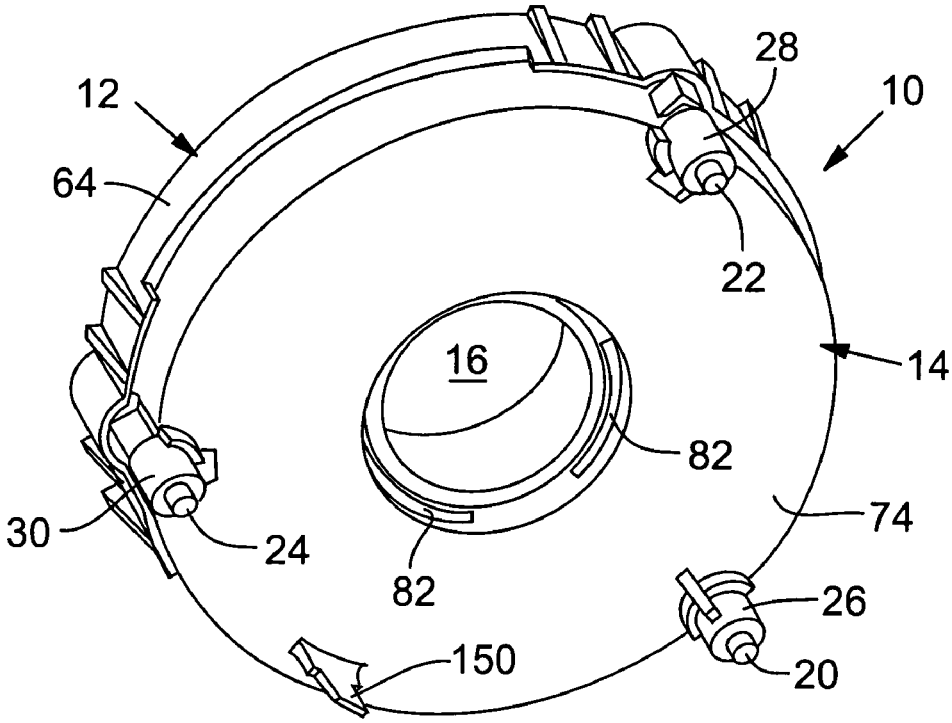
FIG. 1
FIG. 2
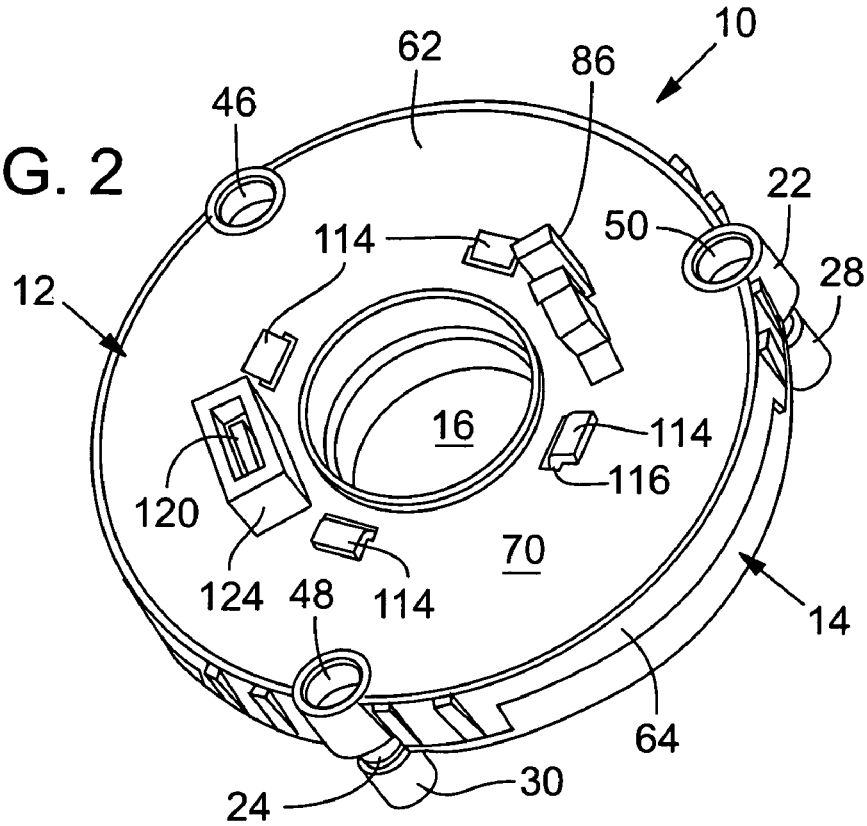

APPARATUS FOR MAKING ELECTRICAL CONNECTION TO A STEERING WHEEL CARRIED PORTION OF AN ELECTRICAL CIRCUIT

RELATED APPLICATION DATA

This application claims the benefit of U.S. provisional patent application No. 60/550,513, filed Mar. 4, 2004, entitled, "Apparatus for Making Electrical Connection to a Steering Wheel Carried Portion of an Electrical Circuit", by Norman E. Ritchie, which is hereby incorporated by reference.

TECHNICAL FIELD

The technology disclosed herein relates to making electrical contact between portions of one or more electrical circuits carried by the rotatable portion of a steering wheel and portions of such circuit which are coupled to or carried in part by a steering column such that they do not rotate as the steering wheel is turned.

BACKGROUND

It is desirable to maintain electrical contact between electrical conductors of one or more circuits carried by a rotatable steering wheel and electrical conductors of the circuits which do not move with the steering wheel.

For example, a triggering signal for deployment of an air bag contained in a steering wheel is typically delivered electrically from an air bag control circuit to an air bag triggering circuit included in the steering wheel with the air bag. In this low power application, one is not concerned with delivering relatively high currents to the steering wheel.

In one common approach, a so-called clock spring mechanism is used to make these electrical contacts. In a clock spring mechanism, a ribbon containing plural electrical conductors is wound into a roll or coil within a housing. The housing has one housing component coupled to the steering wheel and another housing component mounted to the steering column with the two housing components being rotatable relative to one another. The ribbon conductor within the housing makes the connection between one or more electrical circuits carried in part by the steering column and corresponding electrical circuits carried by the steering wheel. The coiled connecting ribbon unwinds and becomes looser as the steering wheel is rotated in one direction. The coil in contrast winds tighter as the steering wheel is rotated in the opposite direction. The housing sections define a central opening through which a portion of the steering column extends with the coil winding and unwinding about the housing portions which define the steering column receiving opening. The housing sections snapfit together adjacent the central opening. A connection made by a coil conductor ribbon which is wound and unwound is thus one suitable approach in a number of applications. However, a need exists for an improved apparatus for these purposes.

SUMMARY

The present invention is directed toward novel and non-obvious combinations and subcombinations of features disclosed herein for making electrical connections between one or more electrical circuits carried by a steering wheel and corresponding portions of such one or more circuits separated from the steering wheel, such as coupled to the steering column which supports the steering wheel for rotation.

In accordance with one embodiment, at least one electrically conductive annulus is carried by one housing section with at least a portion of the annulus surrounding a steering column receiving opening defined by the housing section. The annulus is electrically coupled to an electrical contact for electrical connection to one or more electrical conductors, such as via a connector, of a portion of an electrical circuit. At least one electrically conductive elongated finger is carried by another housing section. By electrically conductive, it is meant that the annulus and the finger provide an electrical path for the flow of current. Although not necessary, desirably the entire annulus and the entire finger is electrically conductive. The finger is electrically coupled to another electrical contact which is designed to make electrical connection to one or more electrical conductors, such as via a connector, of another portion of the electrical circuit. The housing sections are rotatable relative to one another with one of the housing sections desirably being coupled to the steering wheel for rotating with the rotation of the steering wheel and the other housing section desirably being coupled to the steering column so as to remain stationary as the steering wheel is rotated. Upon assembly of the housing sections, the finger, and desirably a finger contact pad portion thereof, slides in contact with an electrical contact surface of the annulus to maintain electrical connection between the two electrical contacts and associated conductors and circuit portions as the steering wheel is rotated.

In one desirable form, the annulus comprises an electrical contact surface facing toward the interior of a chamber defined by the housing sections. In a specific form, the electrical contact surface extends three hundred and sixty degrees about the center of a steering column receiving opening defined by the housing sections. In a specifically desirable form, the electrical contact surface is planar.

The annulus may comprise a body with a first contact tab projecting from the body in a direction away from the interior of the chamber. One of the housing sections supports the annulus and comprises a first contact tab receiving opening through which the first tab extends to make the first tab accessible from the exterior of the supporting housing section. The first tab in this form comprises the first electrical contact. The body of the annulus may also comprise a plurality of crimping tabs with the supporting housing section having a plurality of crimping tab receiving openings. The crimping tabs respectively extend in the exterior direction through the respective crimping tab receiving openings and are crimped at the exterior of the supporting housing section to retain the annulus in position relative to the annulus supporting housing section. Desirably, the annulus, including the body, first tab and crimping tabs, is formed from a planar sheet of electrically conductive material. The body may be in the shape of a ring.

The finger is desirably arcuate in shape and extends from a housing section which supports the finger toward the housing section which supports the annulus. The finger desirably comprises a base which is mounted to an interior surface of the finger supporting housing section. In a specifically desirable form, the finger extends through an arc in excess of ninety degrees about the center of the steering column receiving opening. The finger desirably comprises a resilient member. By resilient, it is meant that the finger has some memory. That is, when the finger is deflected in one direction, a reaction force exists in the opposite direction and urges the finger toward its original position. The finger, and in one specific form a finger contact pad portion, engages the annulus and is deflected toward the housing section which supports the finger as the housing sections are assembled. As a result, the finger is biased toward an electrical contact surface of the annulus.

In a specifically desirable form, the finger comprises a body. The body may comprise a second contact tab which extends in an exterior direction. The finger supporting housing section desirably defines a second contact tab receiving opening through which the second tab projects. The second tab may comprise the second electrical contact. The finger may also comprise a base portion mounted to the interior surface of the finger supporting housing section. The base portion is desirably shorter than the length of the finger. The second tab may project from the base portion. In one desirable embodiment, the entire finger including the base portion, the body and second tab is formed from a single sheet of electrically conductive material, except for a finger contact portion, if included.

Plural fingers and plural annuli may be included for the purpose of making electrical contact with plural circuits.

These and other features and advantages of embodiments will become apparent from the disclosure set forth below and from the accompanying drawings.

DESCRIPTION OF THE DRAWINGS

FIG. 1 is a perspective view of one form of a modular electrical contact maintaining apparatus looking upwardly toward a lower housing section included in the embodiment.

FIG. 2 is a perspective view of the embodiment of FIG. 1 looking downwardly toward an upper housing section included in the embodiment.

DETAILED DESCRIPTION

Figure 7:
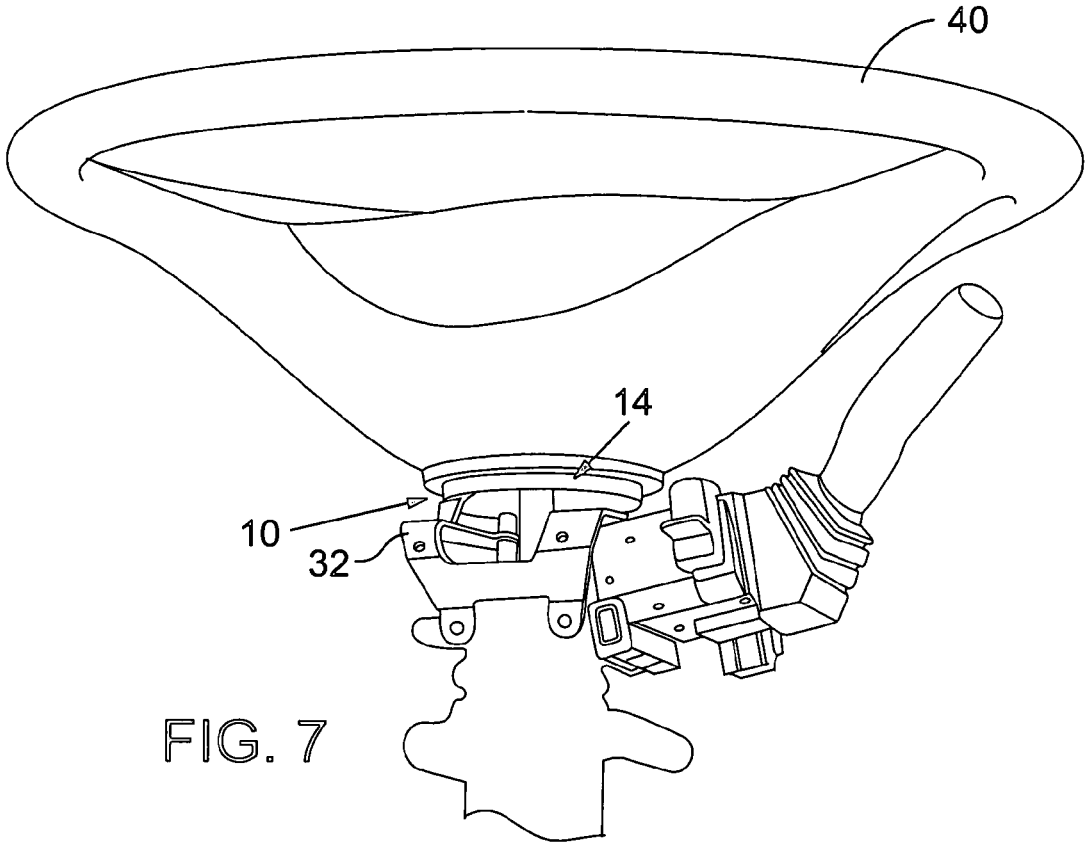
FIG. 7 is a perspective view illustrating an exemplary approach for mounting the embodiment of FIG. 1 to a steering column and steering wheel of a vehicle.

With reference to the figures, FIG. 1 illustrates a modular apparatus for maintaining electrical contact between an electrical conductor of a portion of a circuit coupled to a steering column of a vehicle and an electrical conductor of another portion of the circuit carried by the steering wheel of the vehicle. In the form shown in FIG. 1, the apparatus comprises housing sections 12,14. When assembled as shown in FIGS. 1 and 2, the housing sections 12,14 define a steering column receiving opening 16 through the center thereof through which a portion of a steering column may be inserted. In the embodiments of FIGS. 1 and 2, housing section 14 comprises a lower housing section which is configured for coupling to the steering column. More specifically, spaced apart detachable fasteners 20,22 and 24, such as screws, are received through associated mounting projections 26,28 and 30. Fasteners 20,22 and 24 are received by a bracket 32 (FIGS. 5 and 7), which is carried by the steering column to thereby mount housing section 14 to the bracket. Thus, the housing section 14 is coupled to the steering column such that housing section 14 is maintained in a stationary relationship relative to the steering column and relative to the steering wheel as the steering wheel is rotated or turned. An exemplary steering wheel 40 is shown in FIG. 7.

Referring again to FIGS. 1 and 2, the upper housing section 12 in this embodiment is provided with respective spaced apart fastener access openings 46,48 and 50. The openings 46,48 and 50 are aligned with the respective bosses 22,24 and 26 to provide access to the fasteners 20, 22 and 24 for purposes of allowing the tightening and loosening of the fasteners to and from the steering column mounting bracket while the housing sections 12,14 are in an assembled state.

Figure 5:
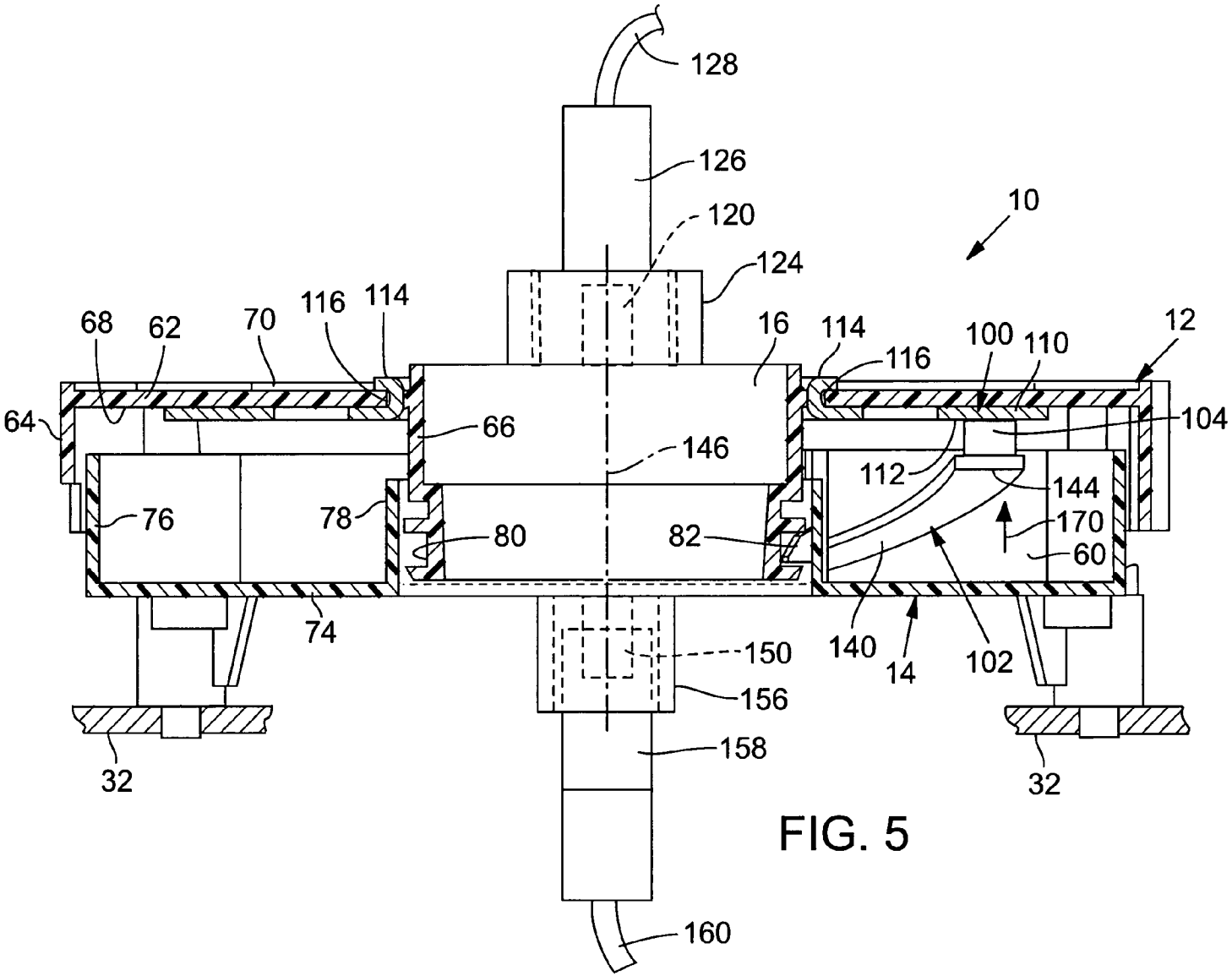
FIG. 5 is a vertical sectional view through an embodiment of an electrical contact maintaining apparatus.

The illustrated housing sections 12,14 are of a generally circular shape. When the housing sections are assembled, they define an interior chamber 60 (FIG. 5) that is generally hollow. As can be seen in FIG. 5, housing section 12 has a base 62 and a perimeter wall 64 which projects outwardly from the base in a direction toward the housing section 14. In addition, the housing section 12 also comprises an interior wall 66 which projects in the same direction as wall 64 to define a portion of the steering column receiving opening 16. Base 62 of housing section 12 has an interior major surface 68 which faces the interior of chamber 60 and an exterior surface 70 opposed to the interior major surface. The illustrated form of housing section 14 comprises a base 74 having a perimeter wall 76 which projects from base 74 and toward the housing section 12. In addition, housing section 14 comprises an interior wall 78 which projects toward housing section 12 in the same direction as wall 76. The wall 78, like the wall 66, is desirably generally circular in shape. Although this form of housing is desirable, other forms may also be used. In addition, each of the housing sections 12,14 may be of a plural piece construction. However, in the form illustrated, each housing section is of a monolithic single piece unitary construction such as being molded of a durable plastic material.

A rotation guiding groove 80 (FIG. 5) is provided in wall 66 and faces the wall 78. Although not required, the groove 80 desirably extends substantially about the entire periphery of wall 66. Groove 80 defines a circular guide path for receiving one or more guides on the housing section 14, such as one or more snapfit connectors. In the illustrated embodiment, at least one snapfit connection 82 projects from wall 78 toward wall 66. When the housing sections 12,14 are assembled, snap fit projection 82 is received in the groove 80. In the form shown in FIG. 4, there are three such snap fit projections 82 (two being shown in FIG. 4). Each of the projections 82 extends through an arc which desirably is in excess of sixty degrees. Although the housing sections may be separately supported or interconnected in other ways, the depicted snap fit interconnection allows housing section 12 to rotate relative to housing section 12 as the steering wheel is turned.

In one convenient approach, a clip connection 86 projects outwardly from base 62 of housing section 12 and is provided for insertion into a clip receiving slot (not shown) in the underside of the steering wheel. Clip connection 86 provides a biased connection to reduce rattle of the housing section 12 relative to the steering wheel. That is, the upwardly projecting legs which form clip 86 are compressed toward one another as the clip 86 is inserted into a clip receiving slot of the steering wheel. Other mechanisms for coupling housing section 12 to the steering wheel may also be used.

One of the first and second housing sections 12,14 carries at least one electrically conductive annulus. The annulus may be carried by either of the housing sections but, in the embodiment shown in FIGS. 3–6, an annulus is carried by housing section 12. One specific form of annulus is indicated at 100 in these figures. The illustrated form of annulus 100 comprises a body portion 110 which may be in the form of a ring. The body portion 110 is desirably positioned such that at least a portion of the body is concentric with the axis about which the steering wheel rotates. An electrical contact, such as an elongated finger contact, one form being indicated at 102 in these figures, carried by the other of the housing sections, in this example by the housing section 14, is maintained in contact with a portion of the body 110 of annulus 100 as the steering wheel is rotated. That is, electrically conductive elongated finger 102 may have an electrically conductive contact pad 104 which is maintained at a constant radius relative to the axis about which the steering wheel rotates. The radial position of contact pad 104 matches the radius of at least a portion of the annulus 100 such that contact pad 104 remains in contact with such portion of the body of the annulus as the steering wheel is rotated. It should be noted that, a highway truck steering wheel is often rotated completely around the steering wheel axis a plurality of times to sharply turn the truck.

Figure 6:
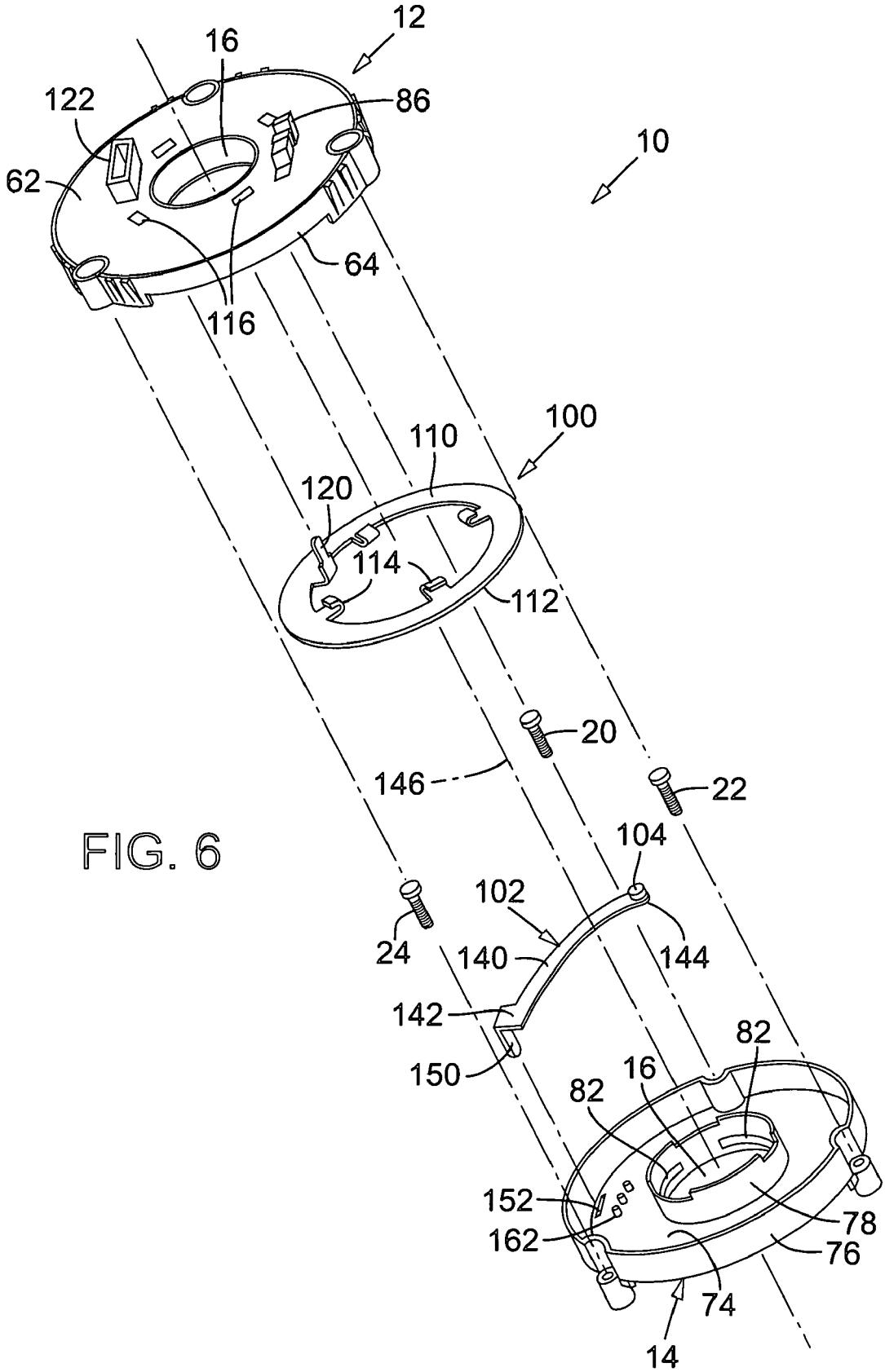
FIG. 6 is an exploded view of an embodiment of an electrical contact maintaining apparatus.

Desirably, the annulus 100 comprises a body 110 which may be of a ring configuration. The illustrated body has a planar electrical contact pad engagement surface 112 which faces the interior of the chamber 60 defined by the first and second housing sections 12,14 when the housing sections are assembled. The body 110 may be mounted to the housing section 12 in any convenient manner such as using fasteners or the like. However, in the illustrated embodiment, body 110 comprises a plurality of spaced apart radially inwardly projecting crimping tabs, such as tabs 114 (two of which are numbered in FIG. 6) spaced ninety degrees apart. The housing section 12 comprises a plurality of crimping tab receiving openings such as slots, two of which are indicated at 116 in FIG. 6. Prior to crimping, each tab 114 includes an upwardly projecting portion which is inserted through the corresponding associated slot 116. Following insertion, the tabs 114 are bent backwardly (as shown in FIG. 6) to crimp the base 62 of housing section 12 between upper and lower portions of the crimping tabs. FIG. 5 illustrates two of the crimping tabs positioned in crimping tab receiving openings 116 (in FIG. 5 the openings 116 are spaced closer to the center of housing section 12 than shown in FIG. 6). FIG. 5 illustrates an example of the crimping tabs 14 being bent back on themselves to crimp against respective portions of surfaces 68,70 of housing section base 62. That is, the base 62 is inserted between sections of the crimping tabs 114 following the insertion of each crimping tab through corresponding associated slot 116. With this mounting approach, the annulus 100 is securely carried by housing section 12 so as to not rotate relative to the housing section.

In addition, the illustrated annulus 100 comprises an upwardly projecting electrical contact 120 which is positioned to extend upwardly through a contact receiving opening 122 (FIG. 3) extending through base 62 of housing section 12. For protection and connection purposes, contact 120 may be at least partially surrounded by a connector housing 124 projecting upwardly from the upper surface 70 of the housing section 12 (see FIGS. 2 and 5). An electrical connector 126, electrically connected to an electrical conductor 128, may be inserted into housing 124 and into electrical engagement with the contact 120. Although not shown, connector 126 and housing 124 may be configured to detachably engage one another, if desired, to assist in maintaining the electrical contact between conductor 128 and contact 120. Desirably, annulus 100 is formed from a single sheet of material and thus the annulus 100 in this form is of a monolithic one-piece construction. A durable electrically conductive contact material may be used for annulus 100, such as a copper alloy.

The illustrated electrical contacting finger 102 comprises an elongated body 140 which is desirably arcuate in shape. Body 140 comprises a base portion 142 and a distal end portion 144 with the electrical contact pad 104 being carried by distal end portion 144. The body is elongated from base 142 to distal end portion 144 and in the form shown desirably extends through an arc which in excess of ninety degrees about the axis of rotation of the steering column. The axis of rotation of the steering wheel is centered in opening 16. A portion of the axis of rotation of this steering wheel is indicated by the dashed line 146 in FIG. 5 and FIG. 6. The finger 102 also desirably comprises an electrical contact which may, as illustrated in FIG. 6, comprise a tab 150 which projects from base 142 in a direction away from the housing section 12. A contact receiving opening, such as slot 152, may be provided through the base 74 of housing section 14. Electrical contact 150 may be inserted through slot 152. In FIG. 1, an exemplary contact 150 is shown exposed following insertion through the slot in base 74 of housing section 14. In FIG. 5, a contact surround 156 projects outwardly from the undersurface of base 74 of housing section 14 and at least partially surrounds the contact 150. Surround 156 has a hollow interior into which contact 150 projects. An electrical connector 158, which is electrically connected to conductor 160 of a circuit, is inserted into surround 156 and into electrical engagement with the contact 150. Although not shown in FIG. 5, connector 158 and connector receiver 156 may detachably engage one another to facilitate the maintenance of the electrical connection between contact 150 and conductors 160. The base 142 of finger 102 may be fastened to the housing section 14 in any convenient manner such as using fasteners. In the illustrated embodiment, base 142 may include a plurality of pin receiving openings (not shown in FIG. 6) for receiving mounting pins (one of such pins is indicated at 162 in FIG. 4) through the pin receiving openings. The base 162 may be soldered, pressfit, or otherwise secured to the pins 162.

Desirably, the finger 102 is formed of a resilient material such that deflection of the finger (such as toward housing section 14) results in a reaction force in the opposite direction, such as indicated by arrow 170 in FIG. 5. The elongated body portion 150 of finger 102 is designed to extend upwardly from base 142 to a position which is above the location of housing section 12 prior to the assembly of housing sections 12 and 14. Consequently, when housing sections 12 and 14 are interconnected, body 140 is deflected downwardly with the result being that pad 104 is biased upwardly against the electrical contact surface 112 of ring 100 (see FIG. 5). This assists in maintaining the electrical contact between contact pad 104 and ring 100 and thus between the conductors 128 and 160 of the respective circuit portions.

Figure 3:
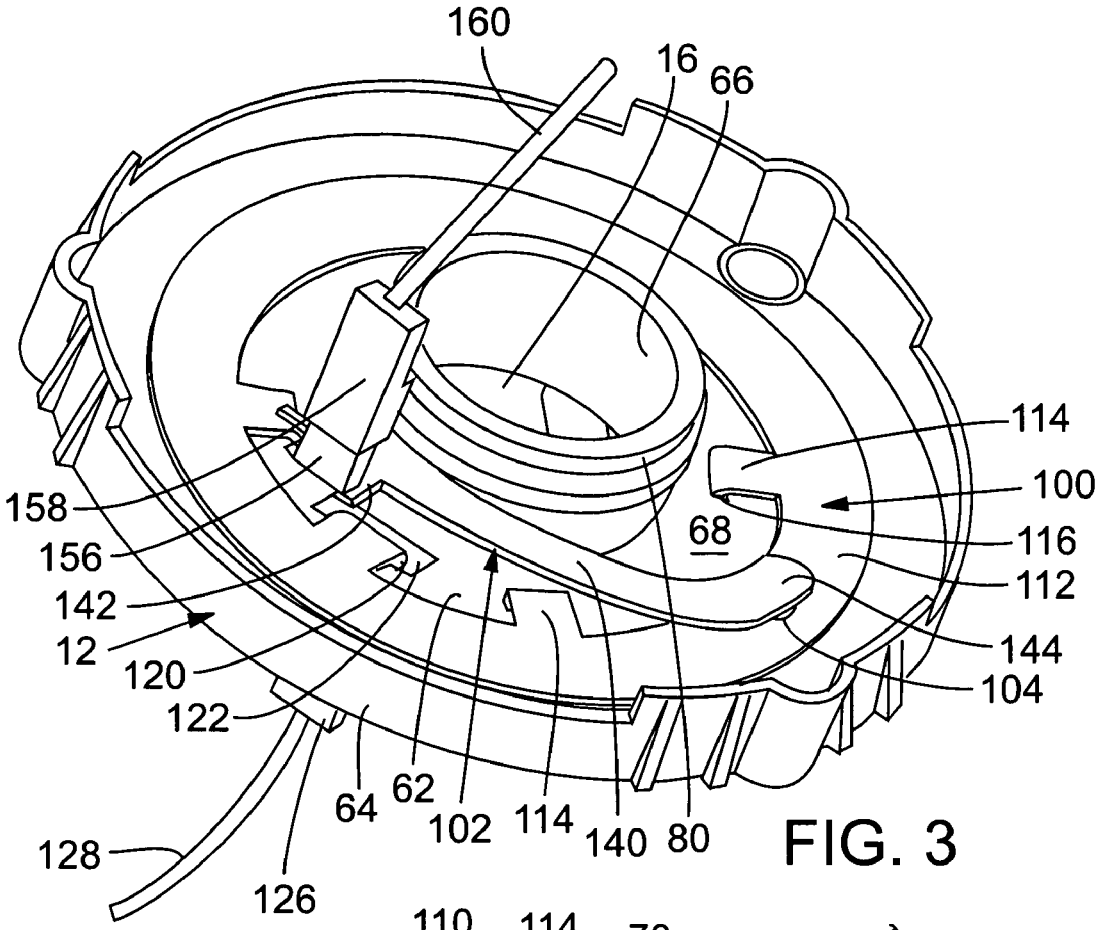
FIG. 3 is a view of an interior portion of the embodiment of FIG. 1 with the lower housing section removed.
Figure 4:
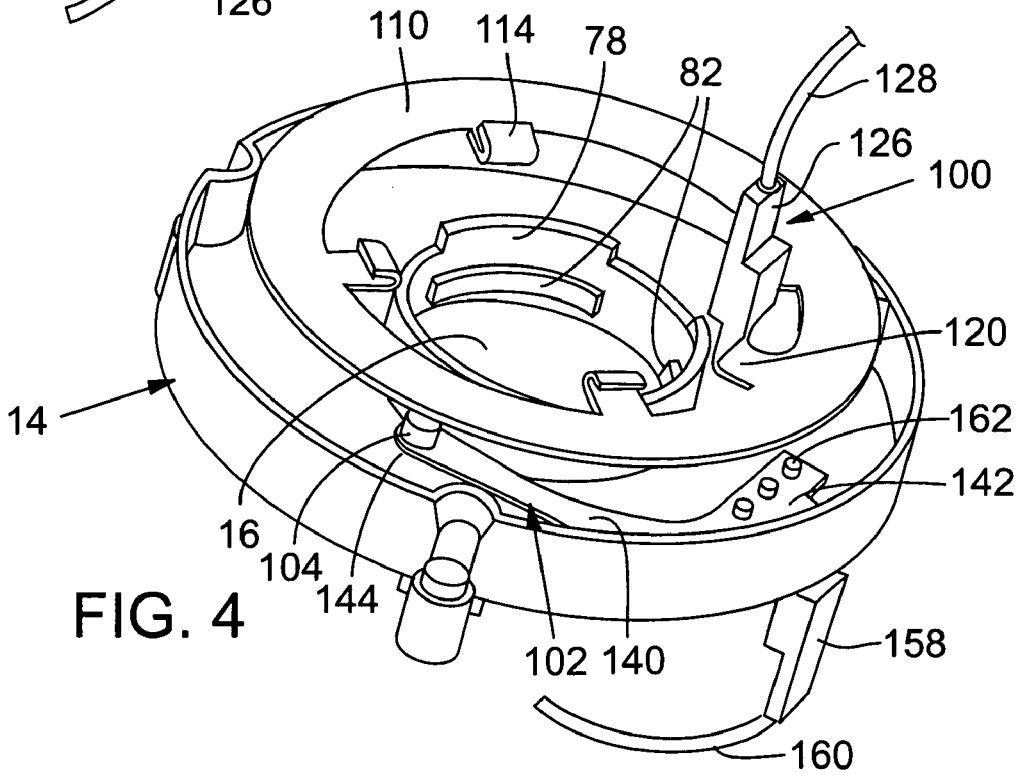
FIG. 4 is a view of an interior portion of the embodiment of FIG. 2 with the upper housing section removed.
Figure 6A:
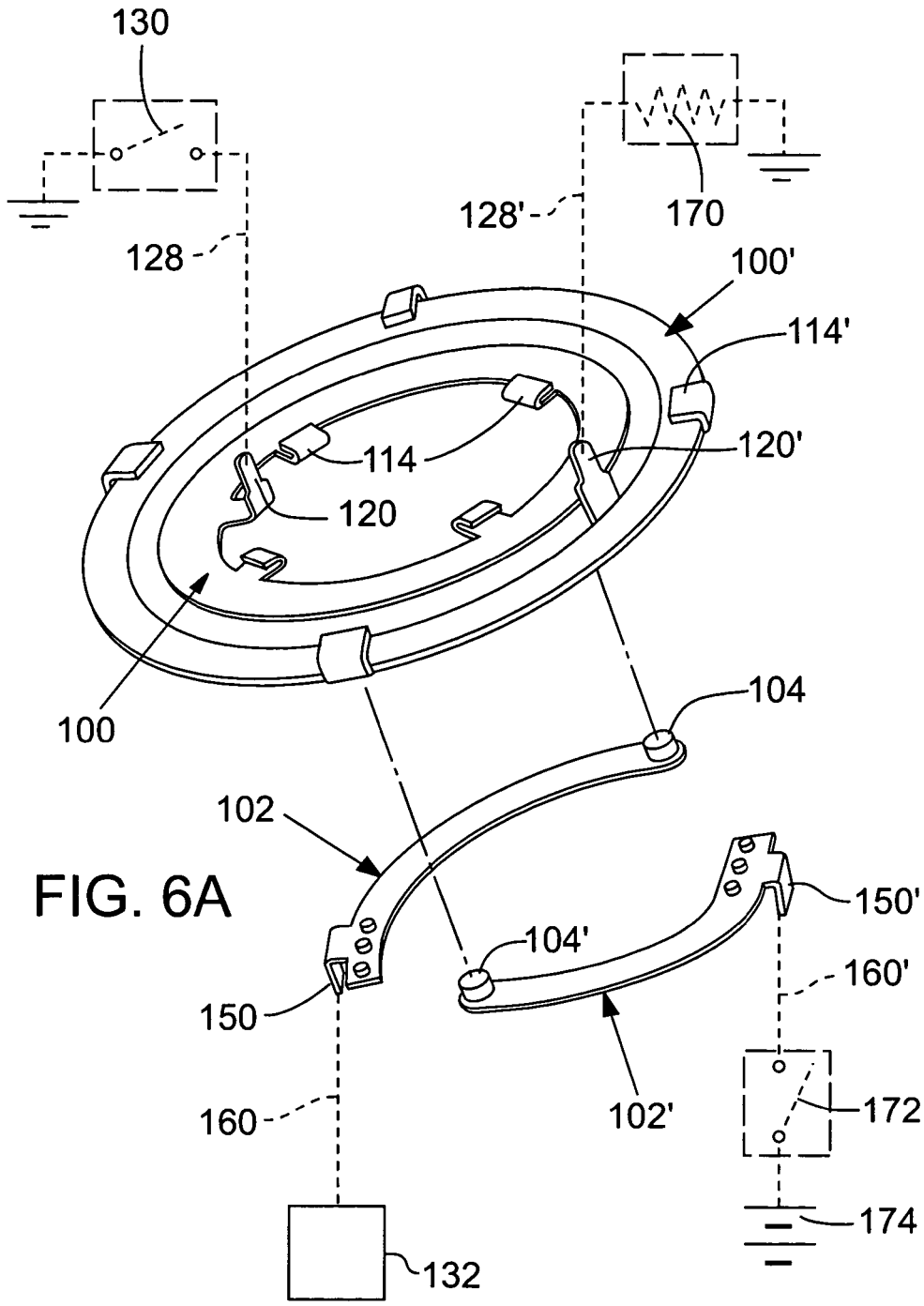
FIG. 6A is an exploded view of portions of an alternative embodiment of an apparatus for maintaining electrical contact between a plurality of electrical circuits.

Desirably, all portions of finger 102 except the contact pad 104 are formed of a single sheet of material and thus finger 102, with the exception of contact pad 104, is of a monolithic one-piece construction. For example, finger 102 may be formed of an electrically conductive metal such as a copper alloy. Contact pad 104 may be formed, for example, of a copper alloy or a nickel-copper alloy and soldered, brazed or otherwise secured to distal end 144 of the body 140. The exemplary contact pad 104 in FIGS. 4 and 6A is a right cylinder having a circular cross-section with a flat circular contact surface. The contact pad 104 of these figures is a solid member having curved wall surfaces facing the directions of sliding of the contact pad on the associated annulus.

FIG. 6A illustrates an embodiment wherein a plurality of steering wheel carried circuits are electrically connected to other components of such circuits which are at a location which is separate from the rotatable steering wheel. In the embodiment of FIG. 6A, the contact 120 is electrically connected by conductor 128 to a horn activating switch 130 on the steering wheel and by conductor 160 to a horn circuit 132. When switch 130 in the FIG. 6A embodiment is closed, the horn circuit 132 is activated and the vehicle horn sounds.

In FIG. 6A, a second annulus 100' and second finger 102' is included in the construction. Corresponding elements to those previously shown in the embodiments of FIGS. 1–6, are designated by the same numbers in FIG. 6A with a "prime" designator. For this reason, these elements will not be described in detail. In the embodiment of FIG. 6A, annulus 100' is concentric with annulus 100 and is electrically isolated from the annulus 100. The diameters of the respective annuli 100, 100' may be reduced such that these components fit within a housing which is dimensionally the same as the housing formed by the housing sections shown in FIGS. 1 and 2. In the embodiment of FIG. 6A, the finger 102' and annulus 100' make electrical contact to a different electrical circuit that is in part carried by the steering wheel and in part separated from the steering wheel. For example, the steering wheel may carry a resistive heater 170 that extends about the entire periphery or portions of the periphery of the steering wheel for purposes of heating the steering wheel when initially used and the cab of the vehicle containing the steering wheel is cold. In this embodiment, the conductor 160' is coupled through a steering wheel heater control switch 172 to a power supply 174. It should be noted that the circuits described in FIG. 6A are simply for the purposes of illustrating the concept as these circuits may vary from those depicted and alternative circuits may be used. These types of circuits may carry greater electrical currents then, for example, carried by circuits which deliver control signals, such as air bag triggering signals. More than two annuli and fingers may be included if additional circuits or conductors are carried by the steering wheel and desirably are to be coupled to circuit portions that are separated from the steering wheel.

Having illustrated and described the principles of my invention with reference to several embodiments, it should be apparent to those of ordinary skill in the art that the invention may be modified in arrangement and detail without departing from such principles. I claim all such modifications as fall within the scope and spirit of the following claims.

I claim:

1. An apparatus for electrically connecting a first electrical conductor of at least one electrical circuit carried by a rotatable steering wheel of a vehicle to a second electrical conductor of an electrical circuit separated from the steering wheel of the vehicle, the apparatus comprising:

first and second annular housing sections, the housing sections being assembled together so as to define a hollow interior chamber, the assembled housing sections defining a steering column receiving opening therethrough and through which a portion of the steering column is insertable;

the first and second housing sections being rotatable relative to one another with the first housing section being coupled to the steering wheel for rotating with the rotation of the steering wheel and the second housing section being coupled to the steering column so as to remain stationary as the steering wheel is rotated;

a first electrical contact carried by the first housing section for connection to the first electrical conductor and a second electrical contact carried by the second housing section for connection to the second electrical conductor;

at least a first electrically conductive annulus carried by one of the first and second housing sections, at least a portion of the first annulus surrounding the steering column receiving opening, the first annulus being electrically coupled to one of said first and second electrical contacts; and at least a first electrically conductive elongated finger carried by the other of said first and second housing sections, the finger being electrically coupled to the said other of said first and second electrical contacts, the finger comprising a finger contact pad portion which is positioned to slide in contact with the first annulus when the housing sections are assembled and the steering wheel is rotated such that the first electrical contact is electrically connected to the second electrical contact and the first electrical conductor is electrically connected to the second electrical conductor when the first electrical conductor is connected to the first contact and the second electrical conductor is connected to the second contact:

wherein the contact pad portion is positioned at one end portion of the finger and projects outwardly from a surface of the finger and being substantially cylindrical; and wherein the finger comprises a body, the body comprising a contact portion positioned at another end portion of the finger and extending in an exterior direction, the other of said first and second housing sections defining a contact portion receiving opening through which the contact portion projects, wherein the contact portion comprises the second electrical contact.

2. An apparatus according to claim 1 wherein the annulus comprises an electrical contact surface facing toward the interior of the chamber, the electrical contact surface extending three hundred and sixty degrees about the center of the steering column receiving opening.

3. An apparatus according to claim 2 wherein the electrical contact surface is planar.

4. An apparatus according to claim 2 wherein the annulus comprises a body, a first contact tab projecting from the body in a direction away from the interior of the chamber, the said one of the first and second housing sections comprising a first contact tab receiving opening through which the first tab extends such that the first tab is accessible from the exterior of the said one of the first and second housing sections, the first tab comprising the first electrical contact, the body further comprising a plurality of crimping tabs, the said one of the first and second housing sections comprising a plurality of crimping tab receiving openings, the crimping tabs respectively extending in an exterior direction through the respective crimping tab receiving openings and then being crimped at the exterior of the said one of the first and second housing sections to retain the annulus in position relative to the said one of the first and second housing sections.

5. An apparatus according to claim 4 wherein the body, the first tab and the crimping tabs are formed from a planar sheet of electrically conductive material.

6. An apparatus according to claim 4 wherein the body is in the shape of a ring.

7. An apparatus according to claim 1 wherein the finger is arcuate in shape and extends from the said other of said first and second housing sections toward the said one of said first and second housing sections, the finger also comprising a base which is mounted to an interior surface of the said other of the first and second housing sections.

8. An apparatus according to claim 7 wherein the finger extends through an arc in excess of ninety degrees about the center of the steering column receiving opening.

9. An apparatus according to claim 7 wherein the finger comprises a resilient member, the finger contact pad portion engaging the annulus and being deflected toward the said other of the first and second housing sections upon assembly of the first and second housing sections, and wherein the finger is biased toward the annulus when the first and second housing sections are assembled.

10. An apparatus according to claim 9 wherein the finger comprises a body, the body comprising a second contact tab which extends in an exterior direction, the said other of the first and second housing sections defining a second contact tab receiving opening through which the second tab projects, the second tab comprising the second electrical contact.

11. An apparatus according to claim 10 wherein the finger comprises a base portion mounted to the interior surface of the said other of the first and second housing sections, the second tab projecting from the base portion, and wherein the body comprises an elongated resilient portion that projects from the base portion.

12. An apparatus according to claim 11 wherein the entire finger is formed from a single sheet of electrically conductive material except for the finger contact portion.

13. An apparatus according to claim 1 wherein the first and second housing sections are configured to engage one another and snapfit together at a location adjacent to the steering column receiving opening.

14. An apparatus according to claim 13 wherein the said one of the first and second housing sections is the first housing section coupled to the steering wheel and the said other of the first and second housing sections is the second housing section coupled to the steering column.

15. An apparatus according to claim 14 further comprising a bracket mounted to the steering column, the second housing section comprising plural spaced apart openings aligned with corresponding openings of the bracket, and detachable fasteners interconnecting the second housing section to the bracket to thereby couple the second housing section to the steering column.

16. An apparatus according to claim 1 wherein the electrical circuit carried by the steering wheel comprises a horn switch and the electrical circuit coupled in part to the steering column comprises a portion of a vehicle horn circuit.

17. An apparatus according to claim 1 wherein the electrical circuit carried by the steering wheel comprises a steering wheel heater circuit and wherein the electrical circuit carried by the steering column comprises a portion of a heater power supply circuit.

18. An apparatus according to claim 1 wherein there are at least two electrically conductive annuli carried by the said one of the first and second housing sections, each of said annuli comprising a respective electrically conductive surface which is concentric with the center of the steering column, the electrically conductive surfaces of the first and second annuli being electrically isolated from one another, and wherein there are at least two of said elongated fingers which are electrically isolated from one another, each of the fingers engaging a respective one of the annuli, each of the annuli and engaging finger being included in a respective electrical circuit such that interconnections between plural circuits are made.

19. An apparatus for electrically connecting a first electrical conductor of at least one electrical circuit carried by a rotatable steering wheel of a vehicle to a second electrical conductor of an electrical circuit separated from the steering wheel of the vehicle, the apparatus comprising:

first and second annular housing sections, the housing sections being assembled together so as to define a hollow interior chamber, the assembled housing sections defining a steering column receiving opening therethrough and through which a portion of the steering column is insertable;

the first and second housing sections being rotatable relative to one another with the first housing section being coupled to the steering wheel for rotating with the rotation of the steering wheel and the second housing section being coupled to the steering column so as to remain stationary as the steering wheel is rotated;

a first electrical contact carried by the first housing section for connection to the first electrical conductor and a second electrical contact carried by the second housing section for connection to the second electrical conductor;

at least a first electrically conductive annulus carried by one of the first and second housing sections, at least a portion of the first annulus surrounding the steering column receiving opening, the first annulus being electrically coupled to one of said first and second electrical contacts;

at least a first electrically conductive elongated finger having a base portion which is mounted to an interior surface of and which is carried by the other of said first and second housing sections, the base portion not extending about the entire center of the steering column receiving opening, the finger being electrically coupled to the said other of said first and second electrical contacts, the finger comprising an annulus engaging distal end contact portion spaced from the base portion and which is positioned to slide in contact with the first annulus when the housing sections are assembled and the steering wheel is rotated, such that the first electrical contact is electrically connected to the second electrical contact and the first electrical conductor is electrically connected to the second electrical conductor when the first electrical conductor is connected to the first contact and the second electrical conductor is connected to the second contact;

wherein the finger comprises a body portion extending from the base portion to the distal end contact portion that is arcuate in shape and extends from the said other of said first and second housing sections toward the said one of said first and second housing sections, wherein the base portion is shorter in length than the body portion; and wherein the base and body portion of the finger extends through an arc in excess of ninety degrees about the center of the steering column receiving opening; and wherein the contact portion has a circular cross-section.

20. An apparatus according to claim 19 wherein the finger comprises a body, the body comprising a second contact tab which extends in an exterior direction, the said other of the first and second housing sections defining a second contact tab receiving opening through which the second tab projects, the second tab comprising the second electrical contact.

21. An apparatus according to claim 20 wherein the body comprises a base portion mounted to the interior surface of the said other of the first and second housing sections, the base portion being shorter in length than the finger.

22. An apparatus for electrically connecting a first electrical conductor of at least one electrical circuit carried by a rotatable steering wheel of a vehicle to a second electrical conductor of an electrical circuit separated from the steering wheel of the vehicle, the apparatus comprising:

first and second annular housing sections, the housing sections being assembled together so as to define a hollow interior chamber and a steering column receiving opening therethrough and through which a portion of the steering column is insertable;

the first and second housing sections being rotatable relative to one another with the first housing section being coupled to the steering wheel for rotating with the rotation of the steering wheel and the second housing section being coupled to the steering column so as to remain stationary as the steering wheel is rotated;

a first electrical contact carried by the first housing section for connection to the first electrical conductor and a second electrical contact carried by the second housing section for connection to the second electrical conductor;

at least a first electrically conductive annulus carried by the first housing section, the first annulus being electrically coupled to the first electrical contact, the first annulus comprising a planar electrical contact surface facing toward the interior of the chamber and extending three hundred and sixty degrees about the steering column receiving opening, and wherein the first annulus comprises a body formed from a single sheet of material, the body comprising a first projecting tab which is bent to extend in an exterior direction, the first housing section comprising a tab receiving opening through which the first tab extends such that the first tab is accessible from the exterior of the first housing section, the first tab comprising the first electrical contact, the body further comprising a plurality of crimping tabs, the first housing section comprising a plurality of crimping tab receiving openings, the crimping tabs being bent to extend in an exterior direction through the respective crimping tab receiving openings and then being crimped at the exterior of the first housing section to retain the ring in position relative to the first housing section;

at least a first electrically conductive elongated finger carried by the second housing section, the finger being electrically coupled to the second electrical contact, the finger comprising a distal end portion with a substantially cylindrical contact portion projecting outwardly from the distal end portion of the finger, the contact portion being positioned to slide in contact with the electrical contact surface of the first annulus when the housing sections are assembled and the steering wheel is rotated, wherein the finger is arcuate in shape, the finger comprising a base which is mounted to an interior surface of the second housing section, wherein the finger comprises a resilient member, the finger contact portion engaging the electrical contact surface of the annulus, the resilient member being deflected toward the first housing section upon assembly of the first and second housing sections, and wherein the finger is biased toward the electrical contact surface of the annulus when the first and second housing sections are assembled, and the base comprising an electrical contact forming second tab projecting from the base in an exterior direction, said second housing section defining a second contact tab receiving opening through which the second contact tab projects, the second contact tab comprising the second electrical contact.

* * * * *